US009987673B2

(12) United States Patent
Karasawa et al.

(10) Patent No.: US 9,987,673 B2
(45) Date of Patent: Jun. 5, 2018

(54) MANUFACTURING APPARATUS FOR HEAT EXCHANGER FINS

(71) Applicant: HIDAKA SEIKI KABUSHIKI KAISHA, Tokyo (JP)

(72) Inventors: Masanao Karasawa, Tokyo (JP); Hirofumi Baba, Tokyo (JP); Toshiyuki Nanaarashi, Tokyo (JP)

(73) Assignee: HIDAKA SEIKI KABUSHIKI KAISHA, Tokyo (JP)

( * ) Notice: Subject to any disclaimer, the term of this patent is extended or adjusted under 35 U.S.C. 154(b) by 34 days.

(21) Appl. No.: 15/109,485

(22) PCT Filed: Mar. 28, 2014

(86) PCT No.: PCT/JP2014/059355
§ 371 (c)(1),
(2) Date: Jul. 1, 2016

(87) PCT Pub. No.: WO2015/145773
PCT Pub. Date: Oct. 1, 2015

(65) Prior Publication Data

US 2016/0325339 A1 Nov. 10, 2016

(51) Int. Cl.
*B21D 53/02* (2006.01)
*B21D 28/00* (2006.01)

(52) U.S. Cl.
CPC ..... *B21D 53/022* (2013.01); *B21D 28/002* (2013.01)

(58) Field of Classification Search
CPC .... B21D 53/02; B21D 53/022; B21D 53/025; B21D 53/04; B21D 53/06; B21D 53/08; B21D 13/02; B21D 13/10; B21D 43/02
(Continued)

(56) References Cited

U.S. PATENT DOCUMENTS 4,898,232 A 2/1990 Ochiai et al.
5,226,343 A * 7/1993 Rawson ..... B06B 3/00 83/508.3

(Continued)

FOREIGN PATENT DOCUMENTS

JP 63-251795 A 10/1988
JP 6-063662 A 3/1994

(Continued)

OTHER PUBLICATIONS

International Search Report (PCT/ISA/210) issued in PCT/JP2014/059355, dated Jul. 1, 2014.

*Primary Examiner* — R. K. Arundale
*Assistant Examiner* — Pradeep C Battula
(74) *Attorney, Agent, or Firm* — Birch, Stewart, Kolasch & Birch, LLP

(57) ABSTRACT

The present invention aims to provide a manufacturing device for heat exchanger fins that is capable of adjusting for differences between a number of punches and a number of through-holes or cutaway portions in an actual product without causing a metal strip to sag or having punches punch the same positions twice. As a solution, a mold (46) is provided with a plurality of punches (75) and a plurality of dies (76) that form a plurality of through-holes or cutaway portions along a conveying direction of a metal strip (49) and also includes a feeding apparatus (50) that feeds the formed plurality of through-holes or cutaway portions in the feeding direction in a single feeding operation, and a cutoff device (60) that cuts the metal strip (49) into predetermined lengths has an equal number of cutoff punches (68) to a number of the punches and dies disposed along the conveying direction of the metal strip (49), includes a plurality of cutoff punch driving units (72) that respectively and individually operate the cutoff punches (68), and also includes
(Continued)

a control unit (80) that controls each of the cutoff punch driving units (72).

2 Claims, 10 Drawing Sheets

(58) Field of Classification Search
USPC ..... 83/687, 56, 408, 341
See application file for complete search history.

(56) References Cited

U.S. PATENT DOCUMENTS 5,349,841 A * 9/1994 Honma ..... B21D 53/02 226/75
5,791,186 A 8/1998 Nishida et al.
6,532,850 B1 * 3/2003 Bergvall ..... B23D 61/126 144/341
8,424,358 B2 * 4/2013 Motoki ..... B21D 13/02 72/379.6
8,925,715 B2 * 1/2015 Karasawa ..... B65H 20/20 198/725
8,973,420 B2 * 3/2015 Nanaarashi ..... B21D 53/02 72/381
9,009,953 B2 * 4/2015 Ueda ..... B21D 53/022 29/33 Q
9,079,277 B2 * 7/2015 Karasawa ..... B21D 53/022
9,089,935 B2 * 7/2015 Karasawa ..... B21D 53/022
9,120,191 B2 * 9/2015 Karasawa ..... B21D 53/022
9,199,346 B2 * 12/2015 Karasawa ..... B21D 53/022
2003/0126743 A1 7/2003 Huang et al.
2012/0255410 A1 10/2012 Kido et al.

FOREIGN PATENT DOCUMENTS

JP 9-155600 A 6/1997
JP 2003-320433 A 11/2003
JP 3881991 B2 2/2007

* cited by examiner

MANUFACTURING APPARATUS FOR HEAT EXCHANGER FINS

TECHNICAL FIELD

The present invention relates to a manufacturing apparatus for fins used in a heat exchanger.

BACKGROUND ART

A heat exchanger, such as an air conditioner, is constructed by stacking a plurality of heat exchanger fins, in which a plurality of through-holes have been formed to enable heat exchanger tubes to be inserted. Such heat exchanger fins are manufactured by a manufacturing apparatus for heat exchanger fins shown in FIG. 12. The manufacturing apparatus for heat exchanger fins is equipped with an uncoiler 12 where a thin metal plate (metal strip) 10 made of aluminum or the like has been wound into a coil. The metal strip 10 pulled out from the uncoiler 12 via pinch rollers 14 is inserted into an oil applying apparatus 16, where machining oil is applied onto the surface of the metal strip 10, and is then supplied to a mold 20 provided inside a press apparatus 18.

The mold 20 internally includes an upper mold die set 22 that is capable of up-down movement and a lower mold die set 24 that is static. The upper mold die set 22 is provided with a plurality of punches along the feeding direction of the metal strip 10. The lower mold die set 24 is provided with dies at positions that are opposite the plurality of punches of the upper mold die set 22. In one closing operation of the upper mold die set 22 and the lower mold die set 24, a plurality of collar-equipped through-holes (not illustrated and sometimes referred to simply as "through-holes" in the present specification) are formed at predetermined intervals in a predetermined direction along the feeding direction of the metal strip.

Note that a feeding apparatus 8 and an inter-row slit apparatus 9 are provided downstream of the mold apparatus 20. The feeding apparatus 8 inserts feed pins into the through-holes of the metal strip 10 and intermittently feeds the metal strip 10 by pulling the metal strip 10. After this, the metal strip 10 in which the through-holes have been formed is cut by the inter-row slit apparatus 9 in the width direction to form a plurality of metal strips of the product width. The metal strips 10 formed in this way are conveyed by a predetermined distance in a predetermined direction, cut into predetermined lengths by a cutoff apparatus 26, and then stacked in a stacker 28.

BACKGROUND ART DOCUMENTS

Patent Documents

Patent Document 1: Japanese Patent No. 3,881,991

SUMMARY OF INVENTION

Technical Problem

The through-holes provided in the metal strips 10 that have been stacked as products in the stacker 28 are the positions where heat exchanger tubes of a heat exchanger, such as an air conditioner, in which the fins are finally housed will be inserted. The number of through-holes that can be formed should preferably be a variety of numbers in keeping with the different configurations of the heat exchangers, such as air conditioners, in which the fins are to be housed.

It is typical for a plurality of through-holes to be simultaneously formed by a single closing operation of the mold, and therefore a plurality of punches and a plurality of dies are provided along the conveying direction of the metal strip. As one example, when five through-holes are simultaneously formed along the conveying direction by one mold closing operation, the feeding apparatus is controlled so as to feed a length equivalent to five through-holes in a single operation in the feeding direction. When five through-holes are simultaneously formed as in the example described above, five punches of the same shape and five dies corresponding to the five punches are disposed along the conveying direction.

Here, although the feeding apparatus is controlled so as to feed in the conveying direction by the equivalent of five formed through-holes in the case where five punches are provided in the example described above, when ten through-holes are necessary for a single heat exchanger fin as the final product, even if the feeding apparatus feeds a length equivalent to five through-holes into a cutoff apparatus, a cutting operation can only be performed after a length equivalent to five through-holes has been fed by another operation by the feeding apparatus.

When the fed number of through-holes differs to the number of through-holes in the product as in the example described above, by allowing the metal strip after the formation of through-holes to sag immediately before the cutoff apparatus (see B in FIG. 12) and setting the feed distance of the metal strip into the cutoff apparatus at a different amount to the feed distance at the mold apparatus, it has been possible to improve the ability to adjust for differences between the number of punches and the number of through-holes actually required by a product.

However, with a heat exchanger fin that has low strength or has high rigidity and easily snapped, it is not possible to have the heat exchanger fin sag and it is not possible to adjust for differences between the number of punches and the number of through-holes actually required by a product. In particular, with a heat exchanger fin that uses multichannel flattened tubes (see, for example, FIGS. 3A and 3B: hereinafter also referred to as "flattened tube fins"), cutaway portions into which flattened tubes are inserted are formed at a plurality of positions, which can lower the mechanical strength of the heat exchanger fin.

When the feed amount and the number of through-holes in a product are different, aside from a method that causes the metal strip to sag immediately before the cutoff apparatus, it would be conceivable to use a method that sets the feed amount smaller than the number of punches and has one or more punches punch again at one or a plurality of through-holes that have already been formed. However, with such method, there is the risk of damage to the product, and it is extremely difficult to have punches punch the cutaway portions and louvers of the flattened tube fin described above twice.

The present invention was conceived to solve the problem described above and has an object of providing a manufacturing apparatus for heat exchanger fins that is capable of adjusting for differences between the number of punches and the number of through-holes or cutaway portions in an actual product without causing a metal strip to sag or having punches punch the same positions twice.

Solution to Problem

A manufacturing apparatus for heat exchanger fins according to the present invention includes: a mold that presses a plurality of through-holes and a plurality of cutaway portions in a thin metal plate to form a metal strip; and a cutoff apparatus that cuts the metal strip, in which the plurality of through-holes and plurality of cutaway portions have been formed, into predetermined lengths, wherein the mold includes a plurality of punches and a plurality of dies that form the plurality of through-holes or the plurality of cutaway portions along a conveying direction of the metal strip, and also includes a feeding apparatus that feeds the formed plurality of through-holes or cutaway portions in the conveying direction in a single feeding operation, and the cutoff apparatus has an equal number of cutoff punches to a number of the punches and dies are disposed along the conveying direction of the metal strip, includes a plurality of cutoff punch driving units that respectively and individually operate the cutoff punches, and also includes a control unit that controls the cutoff punch drive units having determined which cutoff punch out of the cutoff punches is to cut the metal strip, based on a number of feed operations by the feeding apparatus and in keeping with a predetermined number of through-holes or cutaway portions to be formed in the heat exchanger fin being manufactured.

According to the above configuration, by cutting the metal strip by selectively operating one of the plurality of cutoff punches according to the number of feed operations of the metal strip, it is possible to manufacture products with a desired number of through-holes or number of cutaway portions irrespective of the number of punches.

A gap along the conveying direction between the cutoff punches may be an integer multiple of one or higher of a gap between the punches and dies along the conveying direction and may also be smaller than a gap along the conveying direction between the punches and dies as a whole.

Also, when manufacturing a heat exchanger fin with a predetermined number of through-holes or cutaway portions, the control unit may: add, after completion of one mold closing operation of the mold, the gap along the conveying direction between the punches and dies as a whole to a number of through-holes or cutaway portions that extended downstream from the cutoff punch positioned furthest upstream before the mold closing operation to calculate a present value that is a number of through-holes or cutaway portions that presently extend downstream from the cutoff punch positioned furthest upstream; compare the present value and the predetermined number and repeatedly executes mold closing operations by the mold until the present value is at least equal to the predetermined number; divide, when the present value has become at least equal to the predetermined number, a result of subtracting the predetermined number from the present value by the gap along the conveying direction between the cutoff punches; drive, if a remainder produced by dividing is zero, the cutoff punch positioned furthest upstream when a value of the quotient is zero or a cutoff punch a number of positions downstream from a position furthest upstream that increases by one whenever a value of the quotient increases by one, sets, after completion of driving of any of the cutoff punches, the present value at a result of multiplying the gap along the conveying direction between the cutoff punches by a value, which is a position number of the driven cutoff punch from a position furthest upstream and results from subtracting one from an actual position so that "0" is the value furthest upstream and a next position downstream is "1", comparing the present value with the predetermined number, and returning to a step of repeatedly executing mold closing by the mold until the present value is at least equal to the predetermined number; and compare, if the remainder produced by the dividing is not zero, the present value with the predetermined number and returns to a step of repeatedly executing mold closing by the mold until the present value is at least equal to the predetermined number.

Effect of the Invention

According to the present invention, it is possible to adjust for differences between the number of punches and the number of through-holes or cutaway portions in an actual product without causing a metal strip to sag or having punches punch the same positions twice.

DESCRIPTION OF EMBODIMENTS

Figure 1:
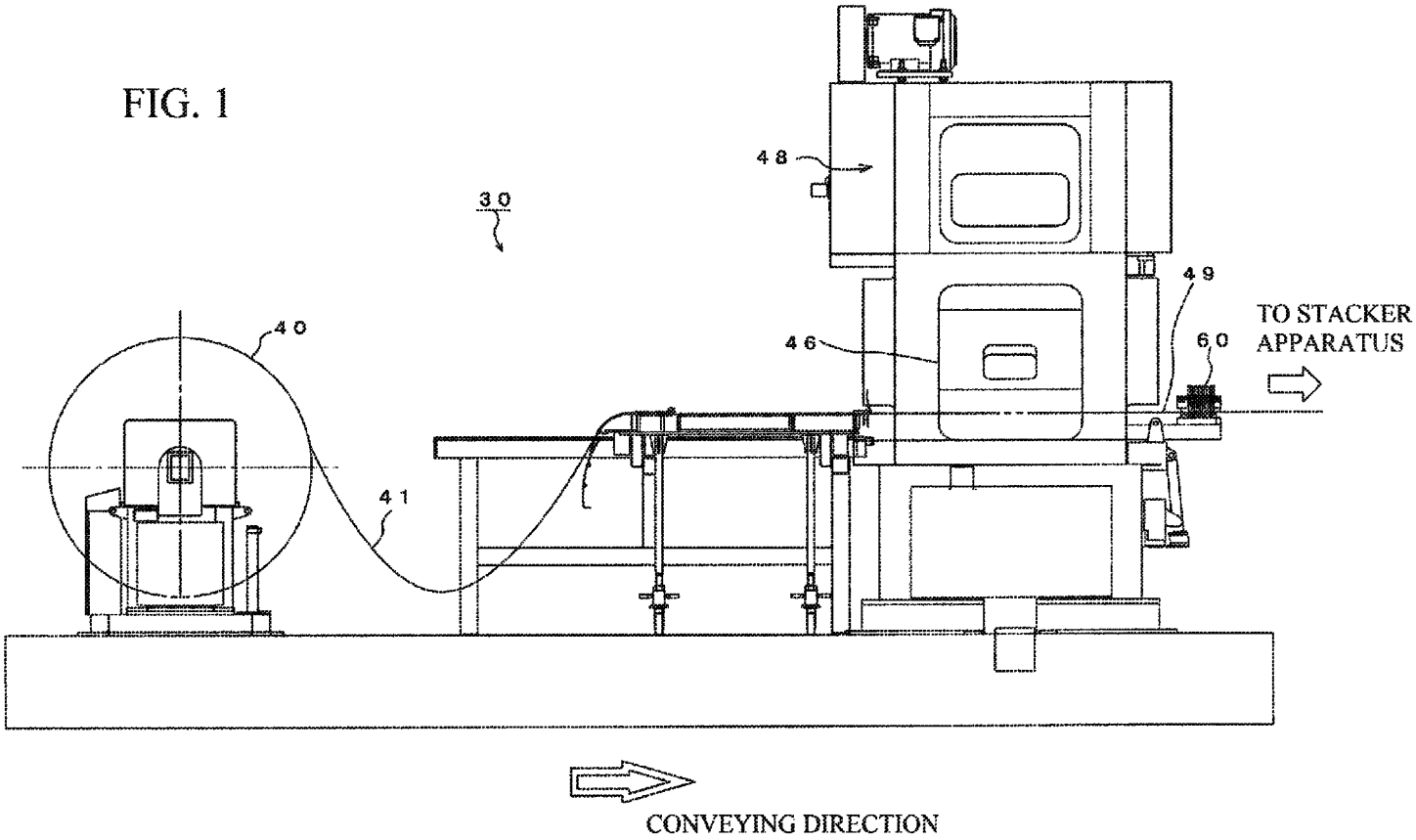
FIG. 1 is a diagram useful in explaining the overall configuration of a manufacturing apparatus for heat exchanger fins according to the present invention.

The overall configuration of a manufacturing apparatus 100 for heat exchanger fins according to an embodiment of the present invention is shown in FIG. 1. Note that the manufacturing apparatus 30 of a heat exchanger fin described below is one example of a manufacturing apparatus that manufactures flattened tube fins in which cutaway portions are formed.

An unmachined thin metal plate 41 made of aluminum or the like is wound into a coil at an uncoiler 40. The thin metal plate 41 is pulled out from the uncoiler 40 by a feeding apparatus, not shown, and is guided into a press apparatus 48.

The press apparatus 48 has a mold apparatus 46 disposed inside. The thin plate 41 is formed into a metal strip 49 of a predetermined shape by the mold apparatus 46.

A cutoff apparatus 60 is provided downstream of the press apparatus 48. The metal strip 49 that has been formed into a predetermined shape is cut into predetermined lengths by the cutoff apparatus 60 to manufacture flattened tube fins 29 as products.

Note that although it is preferable for a stacker apparatus that stacks the manufactured flattened tube fins 29 to be provided downstream of the cutoff apparatus 60, illustration and description of the stacker apparatus is omitted from FIG. 1.

Figure 2:
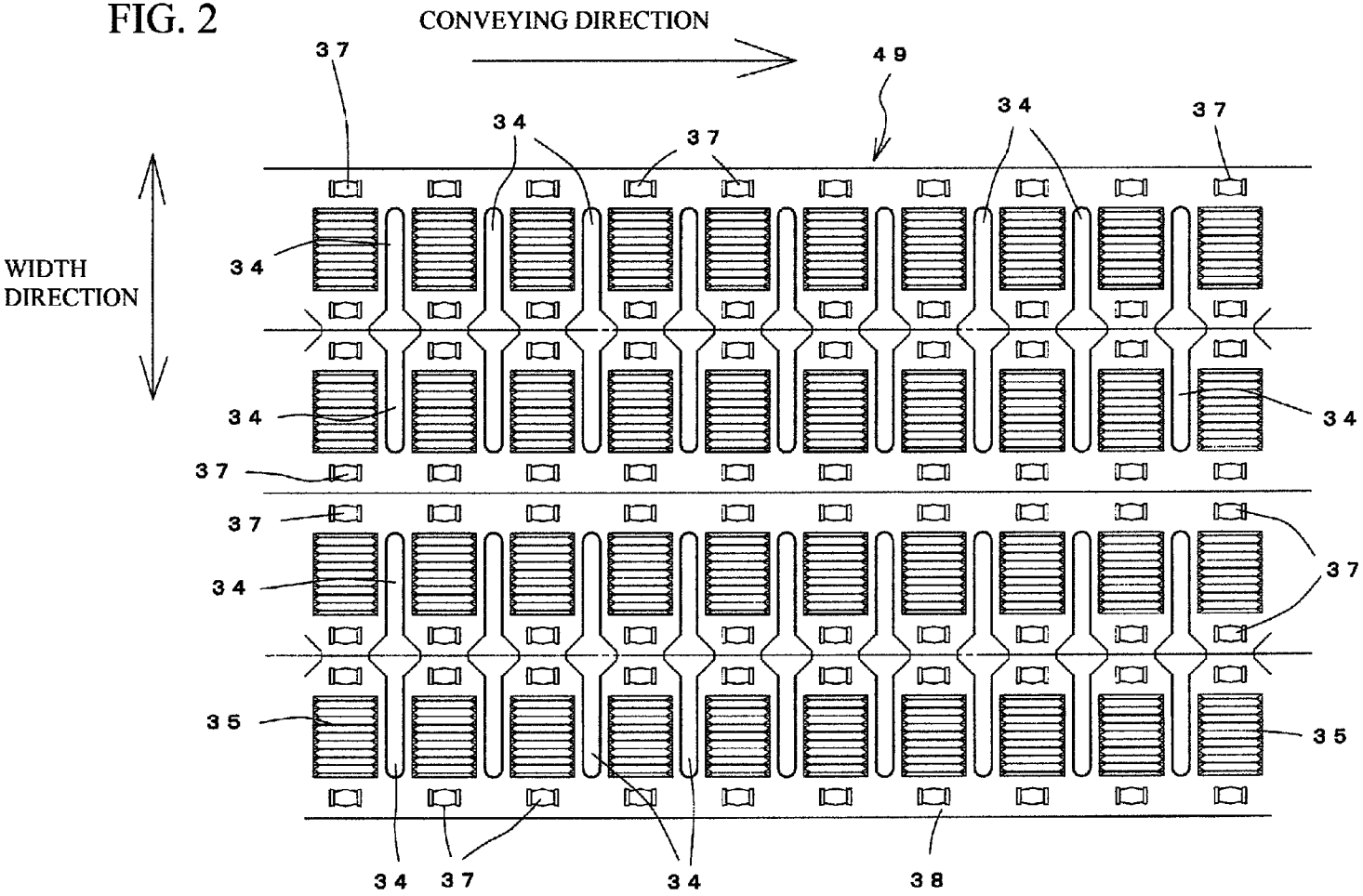
FIG. 2 is a diagram useful in explaining a metal strip formed by a mold apparatus.
Figures 3A, 3B:
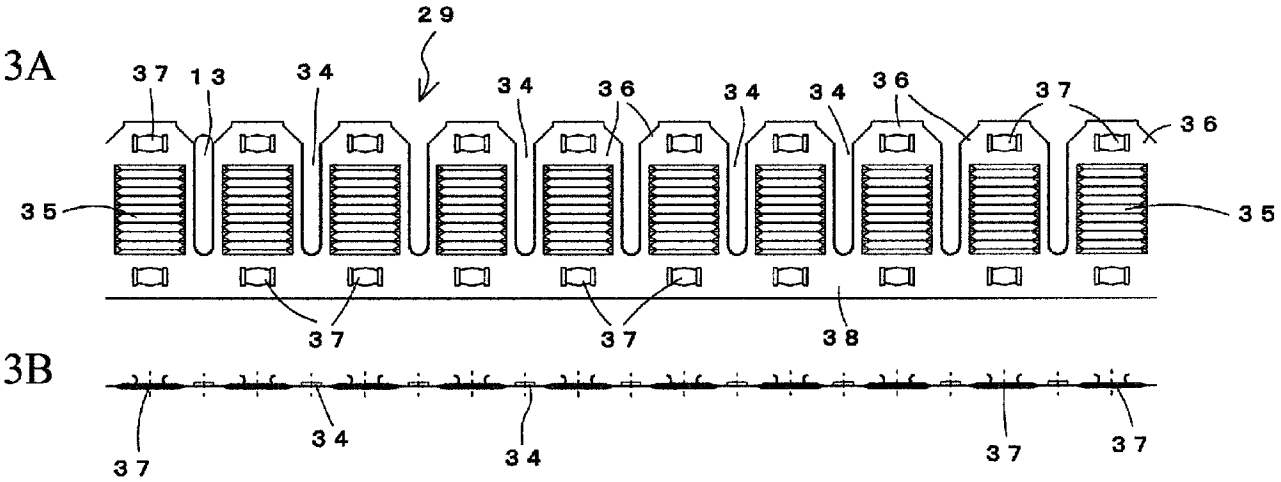
FIG. 3A is a plan view of a flattened tube fin.
FIG. 3B is a side view of a flattened tube fin.

The metal strip 49 formed by the press apparatus 48 is shown in FIG. 2, and the flattened tube fins as products that have been formed by cutting the metal strip 49 into product widths are shown in FIGS. 3A and 3B. The metal strip 49 shown in FIG. 2 has four products formed in a line in the width direction that is perpendicular to the conveying direction. The specific products obtained from the metal strip 49 each have cutaway portions 34, into which the flattened tubes will be inserted, formed at a plurality of positions, with plate-like portions 36, where louvers 35 are formed, being formed between one cutaway portion 34 and another cutaway portion 34.

Openings 37 formed by cutting and folding up the thin metal plate are formed at both end portions in the width direction of the louvers 35. Out of the two openings 37, 37 formed for one louver 35, one opening 37 is formed on the front end side of the plate-like portion 36.

The cutaway portions 34 are formed from only one side in the width direction of each flattened tube fin 29. Accordingly, the plurality of plate-like portions 36 each located between one cutaway portion 34 and another cutaway portion 34 are continuously joined by a joining portion 38 that continuously extends in the length direction. Out of the two openings 37, 37 for one louver 35 described above, the opening 37 on the other side is formed in such joining portion 38.

Figure 4:
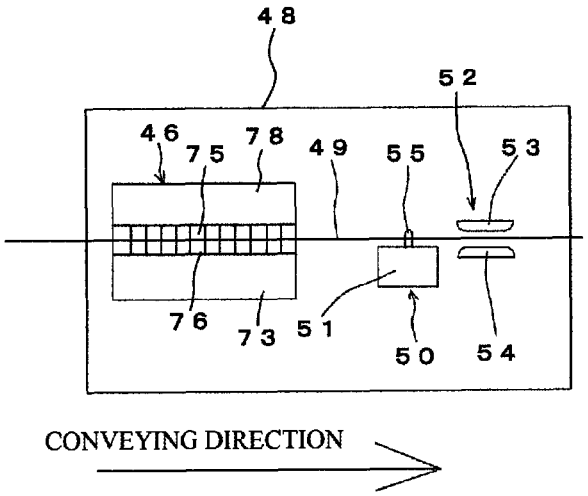
FIG. 4 is a diagram useful in explaining the internal configuration of a mold apparatus.

FIG. 4 shows the overall configuration of a press apparatus. The mold apparatus 46 inside the press apparatus 48 is equipped with a lower mold 73 provided with dies 76 and an upper mold 78 provided with punches 75. The upper mold 78 is lowered toward the lower mold 73 and the cutaway portions 34, the louvers 35, and the openings 37 are formed in the metal strip 49 by the punches 75 and the dies 76.

A feeding apparatus 50 that feeds the metal strip 49 in the conveying direction is provided downstream of the mold apparatus 46. The metal strip that has been machined by the mold apparatus 46 is intermittently fed in the conveying direction by the feeding apparatus 50.

In the feeding apparatus 50, a reciprocating unit 51 that is capable of moving in the horizontal direction moves reciprocally between an initial position and a conveyed position to pull the metal strip 49. Feed pins 55 that protrude upward are disposed on the upper surface of the reciprocating unit 51, the feed pins 55 advance from below into the cutaway portions 34 formed in the metal strip 49, and the metal strip 49 is moved to the conveyed position by pulling with the feed pins 55.

A plurality of (as one example, five) punches 75 and dies 76 are provided in the mold apparatus 46 along the conveying direction of the metal strip 49, so that five cutaway portions 34 are formed by a single mold closing operation of the press apparatus 48. The metal strip 49 is then feed downstream by a length equivalent to five cutaway portions 34 by the feeding apparatus 50 before the next mold closing operation.

When the five cutaway portions 34 have been feed downstream as described above, an unmachined part in which cutaway portions 34 are yet to be formed becomes disposed between the five punches and dies. Five cutaway portions 34 are then formed once again by a mold closing operation of the press apparatus 48.

An inter-row slit apparatus 52 is provided downstream of the feeding apparatus 50. The inter-row slit apparatus 52 includes upper blades 53 disposed on the upper surface side of the metal strip 49 and lower blades 54 disposed on the lower surface side of the metal strip 49. The inter-row slit apparatus 52 may be provided so as to operate using an up-down movement operation of the press apparatus 48. The upper blades 53 and the lower blades 54 are formed so as to be elongated in the conveying direction of the metal strip 49 and the intermittently fed metal strip 49 is cut by the upper blades 53 and the lower blades 54 coming together so as to manufacture products (referred to below as "metal strips of the product width") in the form of long strips in the conveying direction.

The plurality of metal strips 49 of the product width that have been cut to the product width by the inter-row slit apparatus 52 are fed into cutoff apparatuses 60 provided separately for each metal strip 49.

Figure 12:
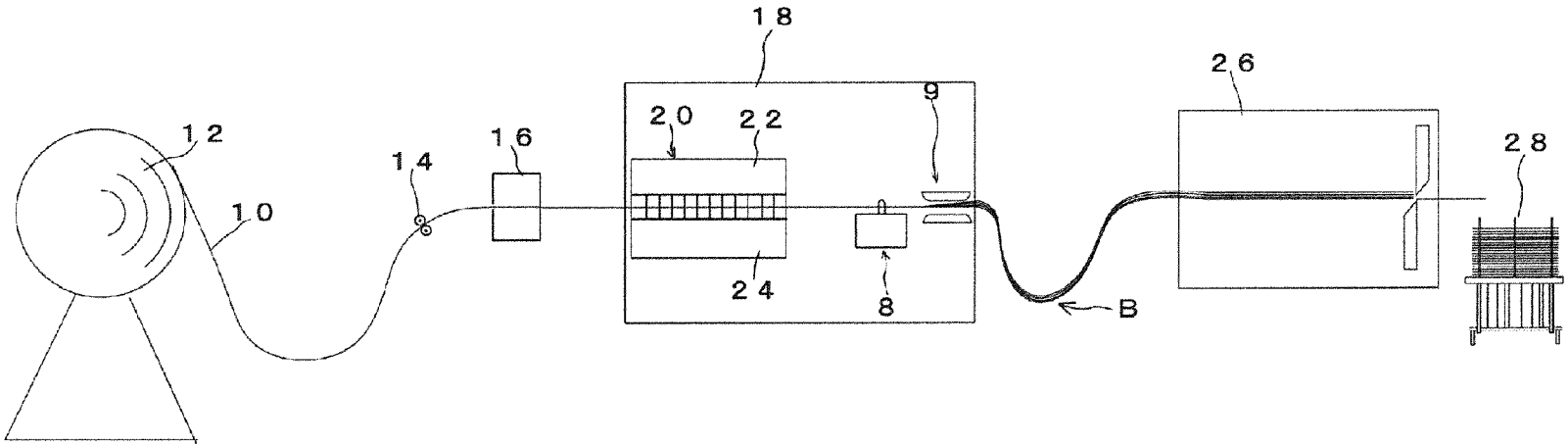
FIG. 12 PRIOR ART
FIG. 12 is a diagram showing the overall configuration of a conventional manufacturing apparatus for heat exchanger fins.

Note that with a conventional manufacturing apparatus, a buffer part is formed between the press apparatus 48 and the cutoff apparatus 60 by allowing the plurality of metal strips 49 of the product width to sag downward (see symbol B in FIG. 12). However, according to the present invention, such buffer part is not necessary due to the cutoff apparatuses 60 having the configuration that is described later in this specification.

Figure 5:
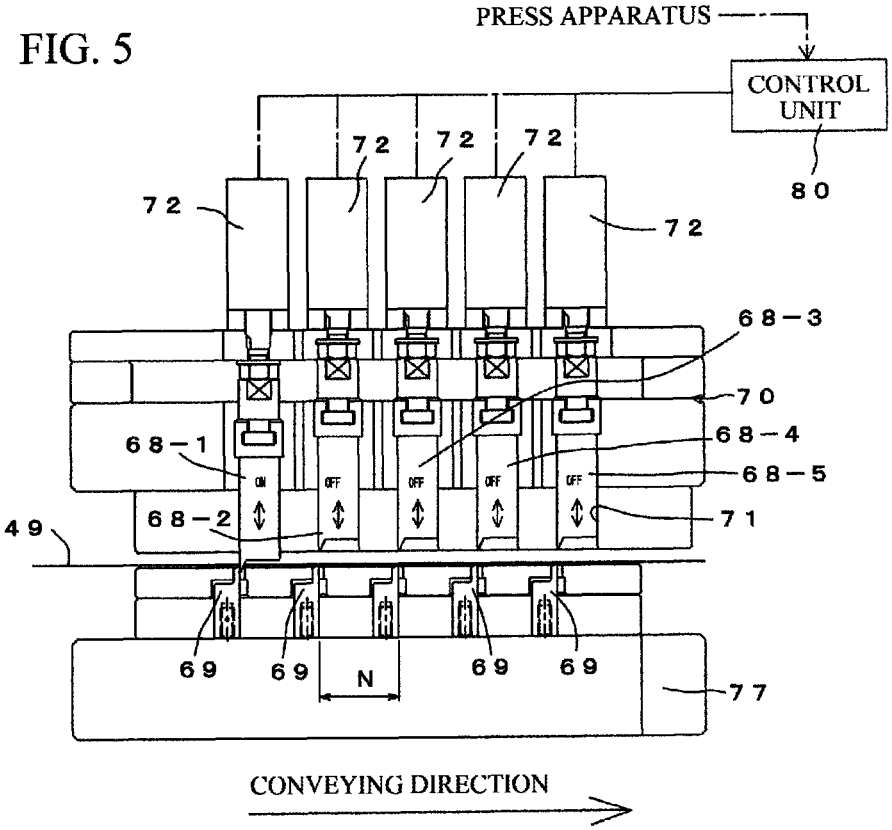
FIG. 5 is a diagram useful in explaining the configuration of a cutoff apparatus.

The cutoff apparatuses 60 are described below with reference to FIG. 5. Each cutoff apparatus 60 forms the flattened tube fins 29 as products by cutting a metal strip 49 of the product width into predetermined lengths. Each cutoff apparatus 60 includes a plurality of cutoff punches 68 along the conveying direction that are disposed on the upper surface side of the metal strip 49 of the product width and a plurality of cutoff dies 69 along the conveying direction that are disposed at positions corresponding to the cutoff punches 68 on the lower surface side of the metal strip 49 of the product width.

The number of the cutoff punches 68 and the cutoff dies 69 provided along the conveying direction is equal to the number of punches and dies provided along the conveying direction of the metal strips 49. Here, since an example where five punches 75 and dies 76 are provided in the conveying direction of the metal strip 49 in the mold apparatus 46 is described above, the cutoff apparatus shown in FIG. 5 also has five cutoff punches 68 and cutoff dies 69 provided along the conveying direction. In FIG. 5, the plurality of cutoff punches 68 have been assigned the numerals "68-1", "68-2", "68-3", "68-4", and "68-5" in order moving downstream from the highest upstream position.

The gap N for disposing the cutoff punches 68 in the conveying direction (that is, the gap for disposing the cutoff dies 69 in the conveying direction) is an integer multiple (one or more) of the gap between the punches 75 (or the gap between the dies 76) along the conveying direction, and is also a smaller gap than the gap between the punches 75 as a whole (or the gap between the dies 76 as a whole) along the conveying direction. More specifically, when the gap between the punches 75 is expressed as X, the gap N between the cutoff punches 68 is X, 2X, 3X, . . . and is smaller than the gap between the plurality of punches 75 as a whole. In the present embodiment, since five punches 75 are provided, the gap between the plurality of punches 75 as a whole along the conveying direction is 5X. Accordingly the gap between the cutoff punches 68 is an interval that is one of X, 2X, 3X, . . . and is smaller than 5X.

Note that with the manufacturing apparatus according to the present invention, since the gap along the conveying direction between the punches 75 is used as a basic unit of length, in the following explanation, the gap between punches is regarded as the pitch and the number of cutaway portions 34 formed by one mold closing operation and then discharged is regarded as "5P" if the number of punches is 5.

The cutoff punches 68 are disposed inside housing holes 71 formed in the upper mold 70 and are capable of moving up and down inside the housing holes 71. The cutoff punches 68 are capable of operating individually, and a cutoff punch driving unit 72 is respectively provided above each of the cutoff punches 68. Actuators such as air cylinders, servo motors, solenoids and the like that are capable of driving the cutoff punches 68 in the up-down direction may be used as the cutoff punch driving units 72. The cutoff dies 69 are fixed inside the lower mold 77 and, together with the lowered cutoff punches 68, cut the metal strip 49.

A control unit 80 for controlling such driving is connected to the cutoff punch driving units 72. The control unit 80 is constructed of components such as a central processing apparatus, such as a CPU, and a memory or the like storing an operation program. A press signal from the press apparatus 48 is inputted into the control unit 80, which is provided to operate in cooperation with the feed timing of the feeding apparatus 50 in the press apparatus 48. The control unit 80 transmits control signals to the cutoff punch driving units 72 to drive the cutoff punches 68 according to a control program set in advance.

When the cutoff punch driving units 72 are air cylinders, the control unit 80 output control signals that control the supplying of air to the air cylinders, while when the cutoff punch driving units 72 are servo motors, solenoids, or the like, the control unit 80 outputs control signals to the servo motors, solenoids, or the like.

Next, a typical method for driving the plurality of cutoff punches will be described with reference to the flowchart shown in FIG. 6. When a manufacturing apparatus for heat exchanger fins starts operating, the upper mold 78 in the mold apparatus 46 operates and in one mold closing operation, the plurality of punches 75 are simultaneously lowered inside the mold apparatus 46. By doing so, a plurality of cutaway portions 34 are simultaneously formed, and the feeding apparatus 50 feeds the metal strip 49 in the conveying direction with the same pitch as the number of the cutaway portions 34 that have been formed (step S100).

The control unit 80 adds the number of cutaway portions fed in the conveying direction after one mold closing operation (expressed as P in FIG. 6) and the present number of cutaway portions 34 that extend in the downstream direction from the cutoff punch 68-1 that is furthest upstream (step S101). The value produced by this addition is hereinafter referred to as the "present value".

Next, the control unit 80 compares the present value calculated in step S101 and the number of cutaway portions required for the flattened tube fin that is the product (the "product section number", which is expressed as the "set value" in this description and as the "predetermined number" in the range of patent claims) (step S102).

When the result of comparing the present value and the set value is that the present value is equal to or above the set value, the control unit 80 advances to the next step, while when the present value is below the set value, the control unit 80 returns to step S100 where the mold closing operation of the mold apparatus 46 is carried out (step S104).

When the present value is equal to or above the set value, the control unit 80 divides a difference, which is given by subtracting the set value from the present value, by the gap (expressed in units of pitch) in the conveying direction between the cutoff punches (step S106).

The control unit 80 determines whether the remainder is zero when the difference produced by subtracting the set value from the present value is divided by the gap (expressed in units of pitch) along the conveying direction between the cutoff punches (step S108). When the remainder is not zero, the control unit 80 returns to step S100 where the mold closing operation of the mold apparatus 46 is carried out.

When the remainder in step S108 is zero, the control unit 80 determines which cutoff punch 68 out of the plurality of cutoff punches is to be driven according to the value of the quotient (indicated as A in FIG. 6) given when the difference produced by subtracting the set value from the present value is divided by the gap (expressed in units of pitch) along the conveying direction between the cutoff punches.

If the value of the quotient is zero (step S110), the control unit 80 outputs a control signal for driving the cutoff punch 68-1 positioned furthest upstream (s112). That is, by cutting using the cutoff punch 68-1, the flattened tube fin that extends downstream from the cutoff punch 68-1 will have the number of cutaway portions that are required as a product. After this, the control unit 80 multiplies the gap along the conveying direction between the cutoff punches by the result of subtracting one from the position of the cutoff punch counting from the highest upstream position and sets the multiplication result as the present value (step S114). When the cutoff punch 68-1 positioned furthest upstream has been driven, since multiplication by zero is carried out, the present value is set at zero. After this, the control unit 80 returns to step S101 where the present value and the set value are compared.

When the value of the quotient is not zero and is one (step S116), the control unit 80 outputs a control signal so as to drive the second cutoff punch 68-2 counting downstream (where "1" is the position furthest upstream) (step S118). That is, by cutting with the cutoff punch 68-2, the flattened tube fin that extends downstream from the cutoff punch 68-2 will have the number of cutaway portions required as a product. The control unit 80 then multiplies the gap along the conveying direction between the cutoff punches by the result of subtracting one from the position of the cutoff punch counting from the highest upstream position and sets the multiplication result as the present value (step S120). When the second cutoff punch 68-2 from the position furthest upstream has been driven, since multiplication by one is carried out, the present value becomes the gap along the conveying direction between the cutoff punches. After this, the control unit 80 returns to step S101 where the present value and the set value are compared.

When the value of the quotient is not zero and is two (step S122), the control unit 80 outputs a control signal so as to drive the third cutoff punch 68-3 counting downstream (where "1" is the position furthest upstream (step S124). That is, by cutting with the cutoff punch 68-3, the flattened tube fin that extends downstream from the cutoff punch 68-3 will have the number of cutaway portions required as a product. The control unit 80 then multiplies the gap along the conveying direction between the cutoff punches by the result of subtracting one from the position of the cutoff punch counting from the highest upstream position and sets the multiplication result as the present value (step S126).

When the third cutoff punch 68-3 from the position furthest upstream has been driven, since multiplication by two is carried out, the present value becomes double the gap along the conveying direction between the cutoff punches. After this, the control unit 80 returns to step S101 where the present value and the set value are compared.

When the value of the quotient is not zero and is three (step S128), the control unit 80 outputs a control signal so as to drive the fourth cutoff punch 68-4 counting downstream (wherein "1" is the position furthest upstream)(step S130). That is, by cutting with the cutoff punch 68-4, the flattened tube fin that extends downstream from the cutoff punch 68-4 will have the number of cutaway portions required as a product. The control unit 80 then multiplies the gap along the conveying direction between the cutoff punches by the result of subtracting one from the position of the cutoff punch counting from the highest upstream position and sets the multiplication result as the present value (step S132). When the fourth cutoff punch 68-4 from the position furthest upstream has been driven, since multiplication by three is carried out, the present value becomes three times the gap along the conveying direction between the cutoff punches. After this, the control unit 80 then returns to step S101 where the present value and the set value are compared.

When the value of the quotient is not zero and is four (step S134), the control unit 80 outputs a control signal so as to drive the fifth cutoff punch 68-5 counting downstream (where "1" is the position furthest upstream) (step S136). That is, by cutting with the cutoff punch 68-5, the flattened tube fin that extends downstream from the cutoff punch 68-5 will have the number of cutaway portions required as a product. The control unit 80 then multiplies the gap along the conveying direction between the cutoff punches by the result of subtracting one from the position of the cutoff punch counting from the highest upstream position and sets the multiplication result as the present value (step S132). When the fifth cutoff punch 68-5 from the position furthest upstream has been driven, since multiplication by four is performed, the present value becomes four times the gap along the conveying direction between the cutoff punches. After this, the control unit 80 then returns to step S101 where the present value and the set value are compared.

Figure 7:
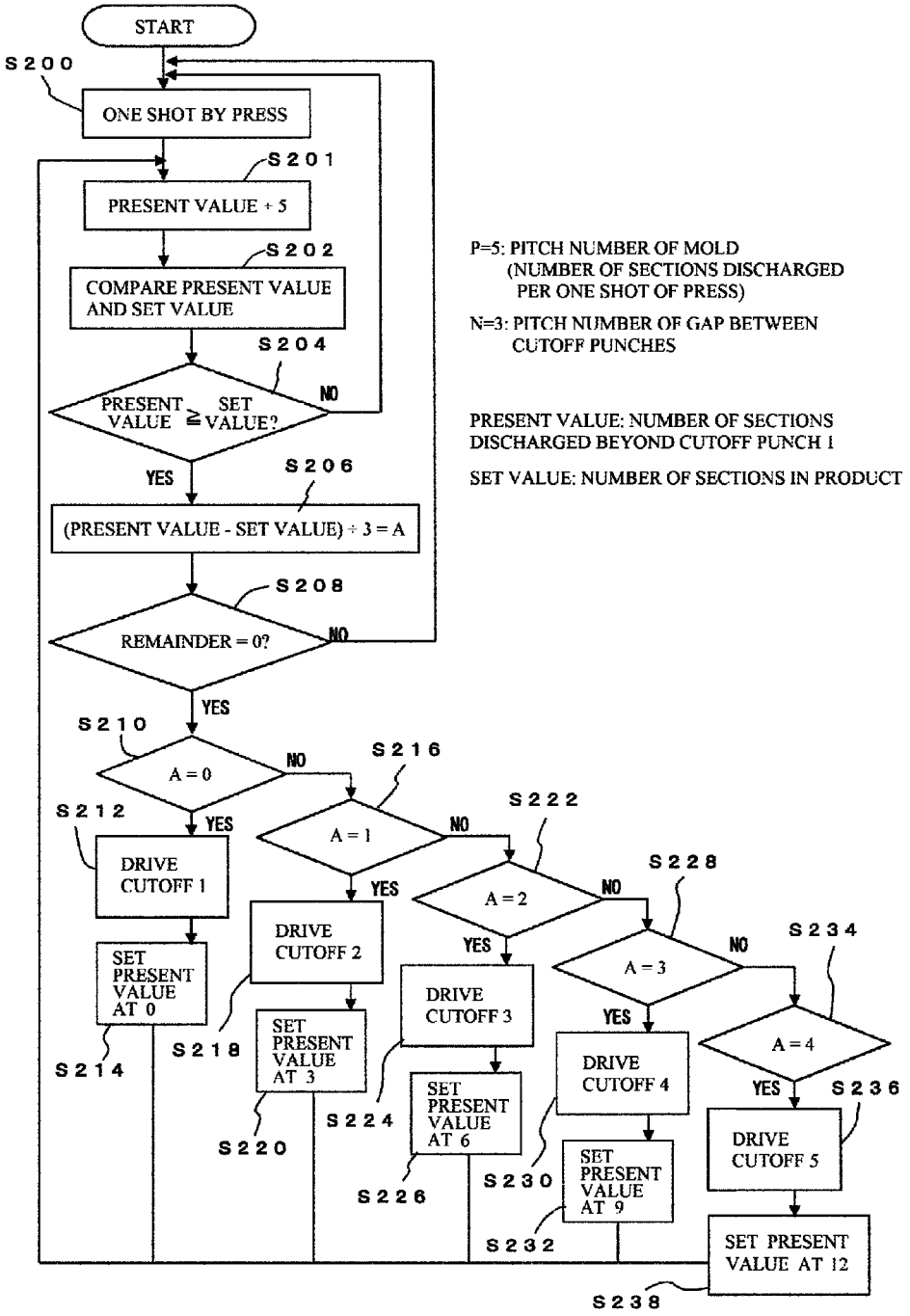
FIG. 7 is a flowchart useful in explaining a driving method for cutoff punches when 5P feeding is carried out.
Figure 8:
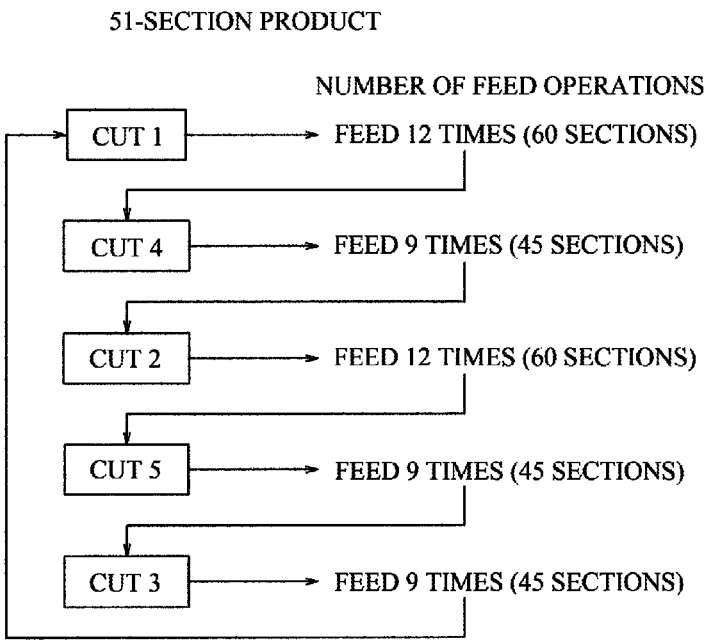
FIG. 8 is a diagram useful in explaining the driving of the cutoff punches and the number of feed operations for a 51-section product.

Next, the method of driving the cutoff apparatus will be described with reference to the flowchart in FIG. 7 and FIG. 8 using specific values. When the operation of the manufacturing apparatus of a heat exchanger fin starts, the upper mold 78 in the mold apparatus 46 operates and in one mold closing operation, the plurality of punches 75 in the mold apparatus 46 are simultaneously lowered. By doing so, five cutaway portions 34 are simultaneously formed and the feeding apparatus 50 feeds the feeding apparatus 50 by 5P in the conveying direction (step S200).

The control unit 80 adds 5, the number of cutaway portions fed in the conveying direction after one mold closing operation, to the number of cutaway portions 34 that presently extend in the downstream direction from the cutoff punch 68-1 positioned furthest upstream (step S201). When the apparatus operates the first time, the number of cutaway portions 34 that extend in the downstream direction from the cutoff punch 68-1 furthest upstream is zero. Accordingly, the present value in step S201 is 5.

Next, the control unit 80 compares the present value calculated in step S201 with the number of cutaway portions required for a flattened tube fin as a product, that is the "product section number" (the "set value" in FIG. 7: an example where a 51-section product is given here) (step S202). Since the present value is 5, this is below 51 which is the set value.

The control unit 80 repeatedly carries out the manufacturing of flattened tube fins by closing the mold apparatus 46 until the present value becomes equal to or above the set value.

When the present value becomes equal to or above the set value, or in other words, when the mold closing and feeding operations have been repeated eleven times so that the present value becomes 55, in step S206 the control unit 80 calculates the quotient of the result of dividing (present value−set value) by the gap along the conveying direction between the cutoff punches. In the present embodiment, since this calculation is (55−51)/3=1 (remainder 1), in step S208 the remainder is not zero and the control unit 80 returns to the step that performs the mold closing operation.

When the mold closing and feeding operations are executed one further time (here, since 11 iterations have already been performed, a twelfth feeding operation is performed), the present value becomes 5×12. In step S206, when the control unit 80 calculates the quotient when dividing (present value−set value) by the gap along the conveying direction between the cutoff punches, the result is (60−51)/3=3 (remainder 0), which means that the control unit 80 can advance to step S210.

Here, since the quotient (A) is 3, the control unit 80 advances to step S228. The control unit 80 then outputs a control signal that drives the fourth cutoff punch 68-4 counting from the position furthest upstream (step S230). Next, the control unit 80 multiplies the gap (3) along the conveying direction between the cutoff punches by the result (4−1) of subtracting one from the position from the furthest upstream cutoff punch, or in other words (3×3=9), and then sets such product (9) as the present value (step S232). After this, the control unit 80 returns to step S201 that compares the present value and the set value.

Since the present value is 9 after cutting by the cutoff punch 68-4, until the present value becomes equal to or above the set value of 51, the manufacturing of flattened tube fins by closing the mold apparatus 46 is repeatedly carried out.

When the present value becomes equal to or above the set value, or in other words, when the mold closing and feeding operations have been repeated nine times so that the present value becomes 45+9=54, in step S206 the control unit 80 calculates the quotient of the result of dividing (present value−set value) by the gap along the conveying direction between the cutoff punches. In the present embodiment, since this calculation is (54−51)/3=1 (remainder 0), the control unit 80 next advances to step S210.

Here, since the quotient (A) is 1, the control unit 80 advances to step S216. The control unit 80 then outputs a control signal that drives the second cutoff punch 68-2 counting from the position furthest upstream. Next, the control unit 80 multiplies the gap (3) along the conveying direction between the cutoff punches by the result (2−1) of subtracting one from the position (2) from the furthest upstream cutoff punch, or in other words (3×1=3), and then sets such product (3) as the present value (step S220). After this, the control unit 80 returns to step S201 that compares the present value and the set value. After the return to step S202, the flow described above is repeatedly executed.

Figure 6:
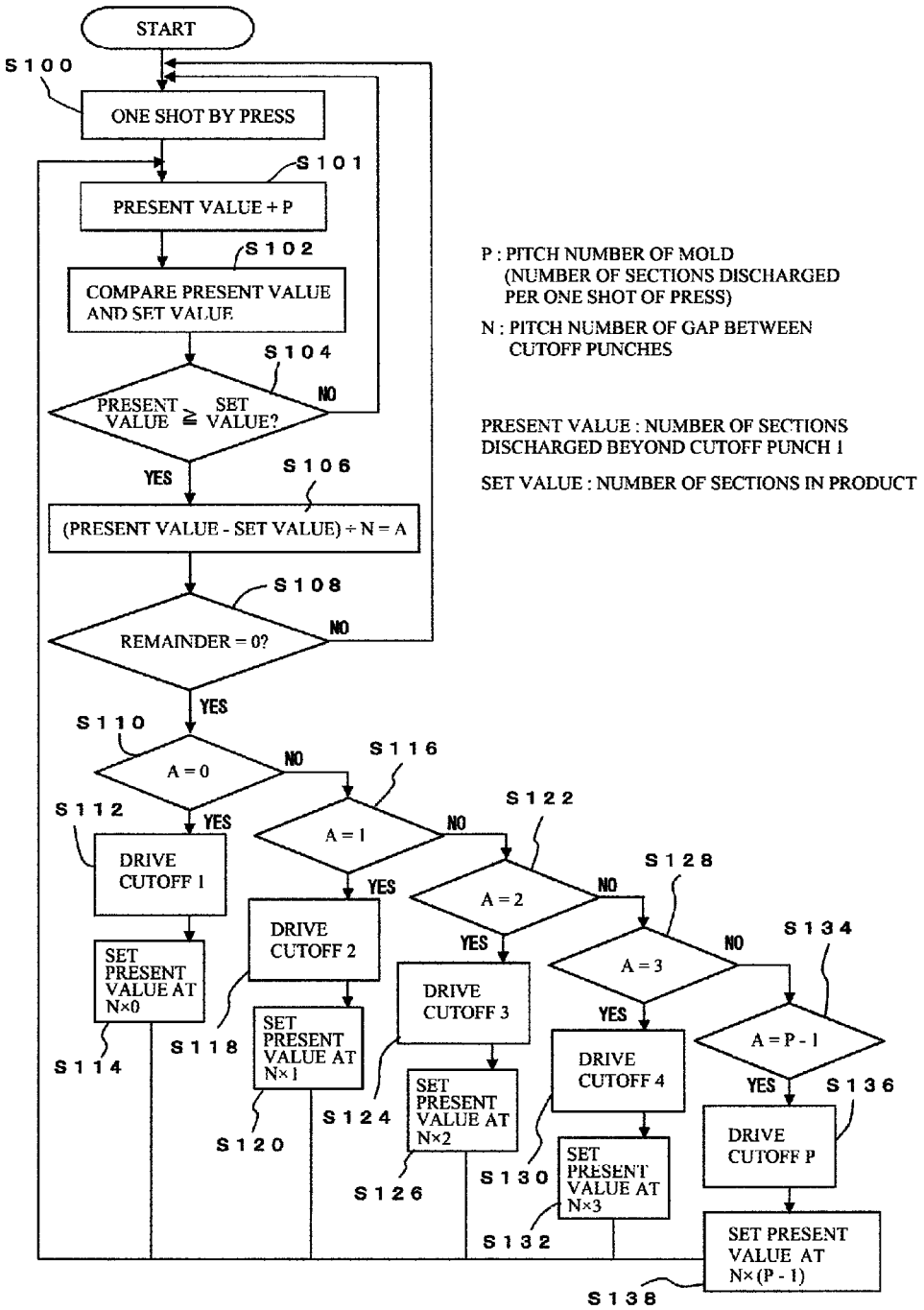
FIG. 6 is a flowchart useful in explaining a method of driving cutoff punches.
Figure 9:
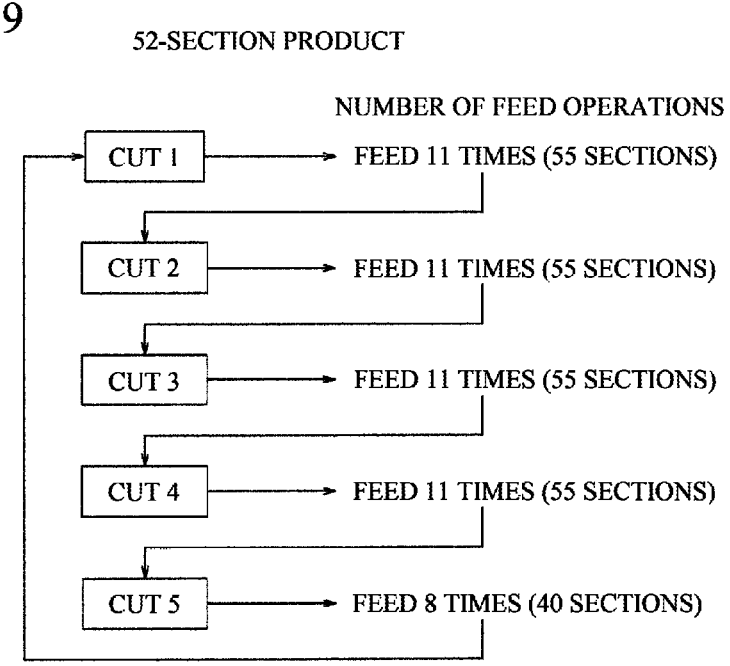
FIG. 9 is a diagram useful in explaining the driving of the cutoff punches and the number of feed operations for a 52-section product.
Figure 10:
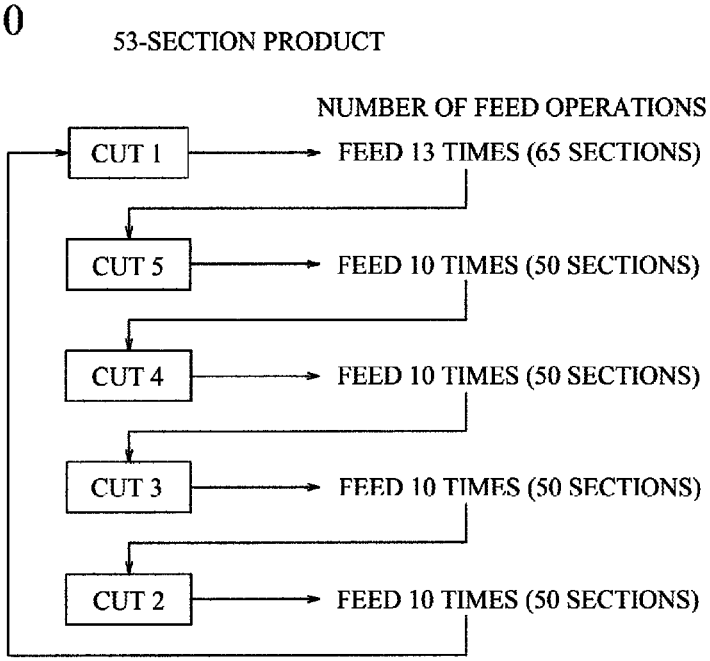
FIG. 10 is a diagram useful in explaining the driving of the cutoff punches and the number of feed operations for a 53-section product.
Figure 11:
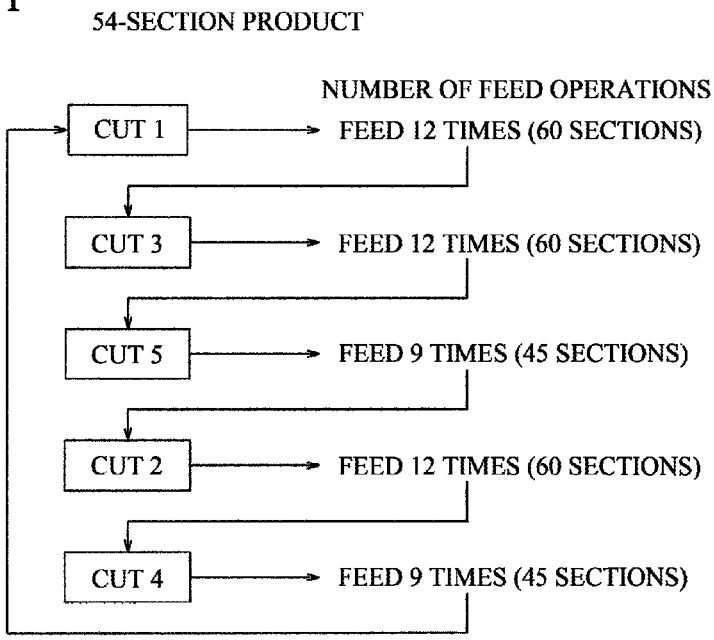
FIG. 11 is a diagram useful in explaining the driving of the cutoff punches and the number of feed operations for a 54-section product.

Note that although a case where the 51-section product is manufactured has been described above with reference to FIGS. 7 and 8, when manufacturing products of different numbers of sections, such as when manufacturing a 52-section product as in FIG. 9, when manufacturing a 53-section product as in FIG. 10, and when manufacturing a 54-section product as in FIG. 11, it is possible to perform manufacturing by controlling the plurality of cutoff punches 68 based on the flow shown in FIG. 6. This means that it is possible to manufacture products of a predetermined number of sections without forming a loop where the metal strip 49 sags between the inter-row slit apparatus 52 and the cutoff apparatus 60 and without striking the same positions twice with the punches. Accordingly, even with an apparatus capable of manufacturing products with various numbers of sections, it is possible to miniaturize the entire apparatus and to carry out manufacturing no drop in productivity.

Although the embodiment is described above by way of an example where the number of punches 75 along the conveying direction is 5 and the feeding apparatus 50 carries out feeding by 5P, the number of punches 75 along the conveying direction may be a number aside from 5.

In addition, although the gap along the conveying direction between the cutoff punches is 3P in the embodiment described above, such gap may be a value that is an integer multiple of one or greater of the gap along the conveying direction between the punches and dies and is also smaller than the gap along the conveying direction between the punches and dies as a whole.

Figure 13A:
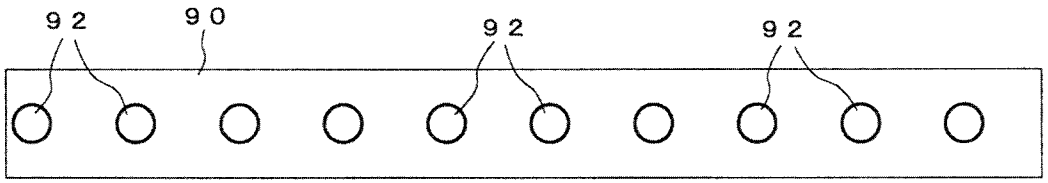
FIGS. 13A and 13B are plan views illustrating fins having through-holes.
Figure 13B:
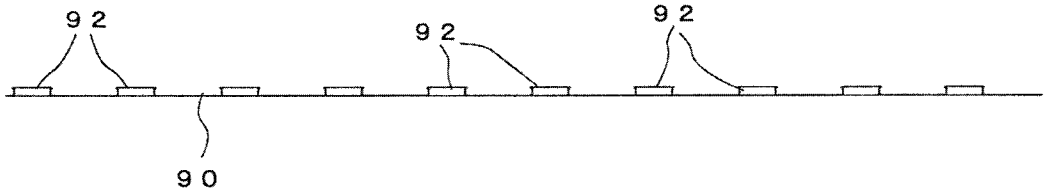

The above manufacturing apparatus has been described by way of an example of a manufacturing apparatus that manufactures flattened tube fins. The present invention can also be applied to a manufacturing apparatus for heat exchanger fins in which collar-equipped holes, into which heat exchanger tubes in the form of round tubes will be inserted, are formed. A fin 90 having a plurality of through-holes 92 is shown in FIGS. 13A and 13B.

Although various preferred embodiments of the present invention have been described above, it should be obvious that the present invention is not limited to such embodiments and can be subjected to a variety of modifications within a range that does not depart from the spirit of the invention.

What is claimed is:

1. A manufacturing apparatus for heat exchanger fins comprising:

a mold that presses a plurality of through-holes and a plurality of cutaway portions in a thin metal plate to form a metal strip; and a cutoff apparatus that cuts the metal strip, in which the plurality of through-holes and plurality of cutaway portions have been formed, into predetermined lengths;

wherein the mold includes a plurality of punches and a plurality of dies that form the plurality of through-holes or the plurality of cutaway portions along a conveying direction of the metal strip, and also includes a feeding apparatus that feeds the formed plurality of through-holes or cutaway portions in the conveying direction in a single feeding operation;

wherein the cutoff apparatus has an equal number of cutoff punches to a number of the punches and dies are disposed along the conveying direction of the metal strip, includes a plurality of cutoff punch driving units that respectively and individually operate the cutoff punches, and also includes a control unit that controls the cutoff punch drive units having determined which cutoff punch out of the cutoff punches is to cut the metal strip, based on a number of feed operations by the feeding apparatus and in keeping with a predetermined number of through-holes or cutaway portions to be formed in the heat exchanger fin being manufactured; and wherein a gap along the conveying direction between the cutoff punches is an integer multiple of one or higher of a gap between the punches and dies along the conveying direction and is also smaller than a gap along the conveying direction between the punches and dies as a whole.

2. The manufacturing apparatus for heat exchanger fins according to claim 1, wherein when manufacturing a heat exchanger fin with a predetermined number of through-holes or cutaway portions, the control unit:

adds, after completion of one mold closing operation of the mold, the gap along the conveying direction between the punches and dies as a whole to a number of through-holes or cutaway portions that extended downstream from the cutoff punch positioned furthest upstream before the mold closing operation to calculate a present value that is a number of through-holes or cutaway portions that presently extend downstream from the cutoff punch positioned furthest upstream;

compares the present value and the predetermined number and repeatedly executes mold closing operations by the mold until the present value is at least equal to the predetermined number;

divides, when the present value has become at least equal to the predetermined number, a result of subtracting the predetermined number from the present value by the gap along the conveying direction between the cutoff punches;

drives, if a remainder produced by dividing is zero, the cutoff punch positioned furthest upstream when a value of the quotient is zero or a cutoff punch a number of positions downstream from a position furthest upstream that increases by one whenever a value of the quotient increases by one, sets, after completion of driving of any of the cutoff punches, the present value at a result of multiplying the gap along the conveying direction between the cutoff punches by a value, which is a position number of the driven cutoff punch from a position furthest upstream and results from subtracting one from an actual position so that "0" is the value furthest upstream and a next position downstream is "1", comparing the present value with the predetermined number, and returning to a step of repeatedly executing mold closing by the mold until the present value is at least equal to the predetermined number; and compares, if the remainder produced by the dividing is not zero, the present value with the predetermined number and returns to a step of repeatedly executing mold closing by the mold until the present value is at least equal to the predetermined number.

* * * * *